US006780260B1

(12) United States Patent
Goldstein et al.

(10) Patent No.: US 6,780,260 B1
(45) Date of Patent: Aug. 24, 2004

(54) NON-WELDED SHAPE MEMORY ALLOY RINGS PRODUCED FROM ROLL FLATTENED WIRE

(75) Inventors: David Goldstein, Potomac, MD (US); Steven S. Kim, Crofton, MD (US)

(73) Assignee: The United Sates of America as represented by the Secretary of the Navy, Washington, DC (US)

( * ) Notice: Subject to any disclaimer, the term of this patent is extended or adjusted under 35 U.S.C. 154(b) by 118 days.

(21) Appl. No.: 10/318,673

(22) Filed: Dec. 10, 2002

(51) Int. Cl.[7] ..... C22F 1/10; C22K 1/00
(52) U.S. Cl. ..... 148/563; 148/676
(58) Field of Search ..... 148/563, 676

(56) References Cited

U.S. PATENT DOCUMENTS

| | | | | | |
|---|---|---|---|---|---|
| 3,351,463 | A | | 11/1967 | Rozner et al. | 75/170 |
| 3,516,082 | A | * | 6/1970 | Cooper | 340/593 |
| 3,957,206 | A | | 5/1976 | Mason | 239/265.33 |
| 3,982,904 | A | | 9/1976 | Nayar | 29/182 |
| 4,907,336 | A | * | 3/1990 | Gianturco | 29/515 |
| 5,160,802 | A | | 11/1992 | Moscrip | 89/16 |
| 5,482,574 | A | | 1/1996 | Goldstein | 148/517 |
| 5,856,631 | A | | 1/1999 | Julien | 89/16 |
| 6,240,727 | B1 | | 6/2001 | Goldstein et al. | 60/528 |
| 6,293,020 | B1 | | 9/2001 | Julien | 30/350 |
| 6,321,656 | B1 | | 11/2001 | Johnson | 102/377 |
| 6,338,242 | B1 | | 1/2002 | Kim et al. | 60/204 |
| 6,422,010 | B1 | | 7/2002 | Julien | 60/527 |
| 6,425,829 | B1 | | 7/2002 | Julien | 470/11 |
| 2002/0189727 | A1 | * | 12/2002 | Peterson | 148/563 |

* cited by examiner

*Primary Examiner*—George Wyszomierski
(74) *Attorney, Agent, or Firm*—Mark Homer

(57) ABSTRACT

A method for producing a non-welded shape memory alloy ring, such as Nitinol, includes a wire segment. The alloy ring may be used in a venting mechanism for rocket motors or as a coupling device, such as for fitting piping.

14 Claims, 1 Drawing Sheet

NON-WELDED SHAPE MEMORY ALLOY RINGS PRODUCED FROM ROLL FLATTENED WIRE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention provides a novel improved manufacturing process for producing shape memory alloy rings.

2. Brief Description of the Related Art

Shape memory alloys, such as Nitinol, having been disclosed in U.S. Pat. No. 6,321,656 to Johnson (Nitinol ring used in venting of rocket casing), U.S. Pat. No. 6,293,020 to Julien (cutting blanks from a Nitinol sheet) and U.S. Pat. No. 5,312,152 to Woebkenberg, Jr. et al. (process utilized to preset a shape in a shape memory alloy). However, none of these patents discloses an efficient and simple method of producing shape memory alloy rings as taught herein.

Current methods of forming the shape memory alloy rings include spot and butt welding techniques. The use of materials with weld points in critical applications, however, remains suspect for safety and performance reliability.

There is a need in the art to provide a method of producing shape memory alloy rings that is simple and efficient, while providing increased reliable safety and performance characteristics. The present invention addresses this and other needs.

SUMMARY OF THE INVENTION

The present invention includes a method for producing a non-welded shape memory alloy ring comprising the steps of forming a wire segment comprising a shape memory alloy to a given length proportional to a desired ring size, wherein the wire has a given cross-sectional dimension proportional for a desired thickness and width, annealing the cut wire, roll flattening the annealed cut wire to the desired thickness and width, slitting the length of the roll flattened wire along the centerline to form a precursor, opening the slit and annealing the opened slit on a mandrel to form a non-welded ring. The preferred shape memory alloy includes Nitinol.

The non-welded ring is particularly applicable for use in rocket motor venting ring systems and/or coupling devices, such as pipe fittings.

DETAILED DESCRIPTION OF THE PREFERRED EMBODIMENT

Figure 1:
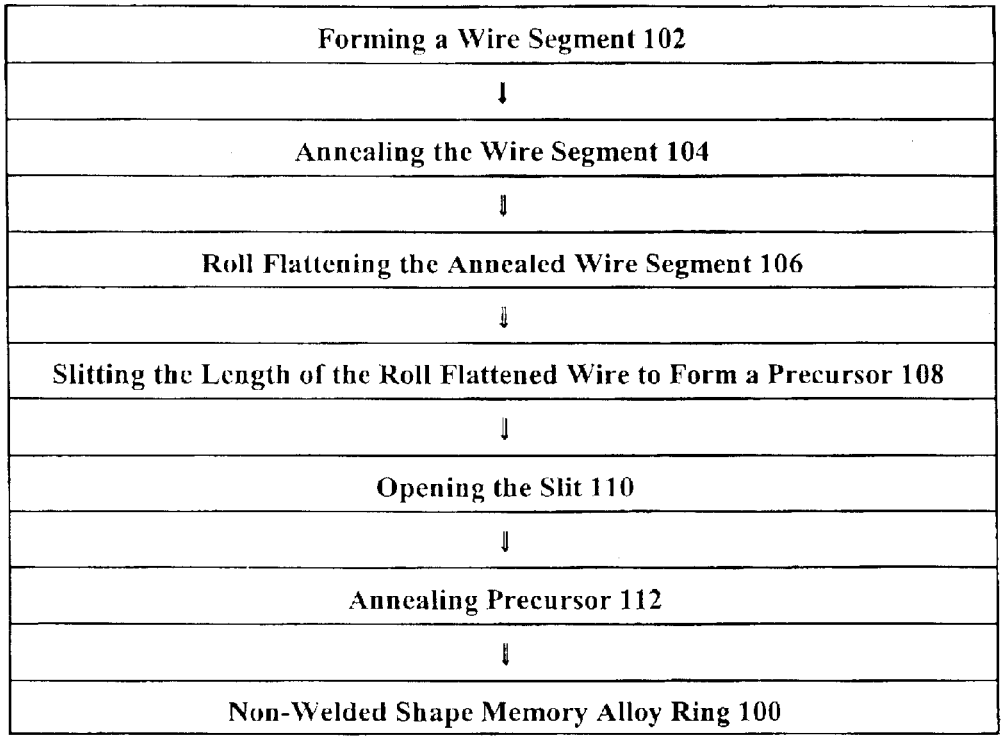
FIG. 1 is a schematic representation of the process steps of the present invention.

The present invention provides for a novel method of manufacturing rings for venting systems on rocket motors, or pipe connections. The method of manufacture provides a non-welded ring resulting from a simplified procedure that reduces cost, time and logistical coordination in manufacturing the rings.

Several alloys are known to exhibit shape memory properties. The shape memory metal alloy, or shape memory alloy (SMA), exhibit the property of "remembering" a preset or "stored" shape, even after the material is severely deformed into a different shape. The shape memory recovery is induced by the application of sufficient heat which can be triggered at a preset temperature that is determined by the particular alloy composition. Although transformation temperatures span a large range (such as between −100° C. and +100° C.), the recovery rate of the SMA generally is limited by how fast heat can be applied.

The "mechanical memory" of the SMA is a function of the temperature and strain history of the material. In shape memory alloys the deformation occurs by changing the "tilt" of a twin orientation of crystals which does not cause any dislocation motion. Instead, the crystal structure of the martensite (cold phase) forms by the shearing of the austenite lattice (hot phase). Upon heating, this permits only one crystalline direction that the martensite lattice can move in when restoring to the austenite structure. Accordingly the SMA, in the martensite (cold) phase, "remembers" or restores to the shape formed in the austenite (hot) phase. Because the shape memory recovery process does not damage the crystalline structure, a very high fatigue life can be obtained even under large strains and stresses. For example, the "mechanical memory" of Nitinol (described below) is attributed to a unique second order martensitic chrystalline phase transformation which occurs across a critical transition temperature, designated $A_s$. This property enables Nitinol alloys to recover a given shape after having been mechanically distorted at some temperature below $A_s$, by simply heating the material to some temperature above $A_s$. The critical transition temperature $A_s$ for nominal 55-Nitinol is approximately 60° C. (140° F.). For single cycle applications, i.e., one-time actuation, Nitinol reliably recovers up to an 8% memory strain ($\delta L/L$) without significant residual strain. For applications involving a few cycles (for example, <10), a 5% memory strain becomes a reasonable design guideline, and for multiple cycle applications (up to approximately 10 million), a 3% memory strain is a reasonable design guideline.

The formed rings of the present invention may include those shape memory alloys having suitable ductile and deformation properties, such as a number of shape memory alloys commercially available, including Raychem K-alloy (Ti—Ni—Cu), copper-aluminum-nickel, copper-zinc-aluminum, and titanium-cobalt-nickel and Nitinol (NiTi or NiTiNOL), with Nitinol preferred. At cryogenic temperatures, an alloy such as iron-doped or chromium-doped Ni—Ti can be employed.

Nitinol is a nickel titanium SMA developed, in the early 1960's, at the Naval Ordnance Lab. These nickel-titanium alloys are based upon the ductile intermetallic compound TiNi. Nominal 55-Nitinol (55% nickel, 45% titanium by weight) is nearly stoichiometric TiNi, with a density of 0.22304 pounds per cubic inch and a melting point of 1310° C. Nominal 55-Nitinol exhibits single phase and ductile properties, and has an ultimate tensile strength of 125,000 psi and a modulus of elasticity of $12.0\times10^6$ psi. SMA materials are available from Shape Memory Applications of Sunnyvale, Calif. or Furukawa Electric of Tokyo, Japan.

The use of wire to form the SMA rings as taught herein is believed to impart superior properties to the formed rings than the rings formed from sheet manufacture. With wire drawing, which comprises an elongation process, a more pronounced grain structure anisotropy results than sheet or strip material, as sheet rolling uses a squeeze or compression process. This results in SMA rings from the wire possessing of the present invention forming superior shape recovery properties of the finally formed ring.

As seen in FIG. 1, the non-welded shape memory alloy rings 100 of the present invention are produced by forming a wire segment 102, such as by cutting a wire comprising a shape memory alloy to a given length proportional to a desired ring size with the wire having a given cross-sectional dimension proportional for a desired thickness and width, annealing the cut wire segment 104, roll flattening the annealed cut wire to the desired thickness and width 106, slitting the length of the roll flattened wire along the centerline 108 wherein a precursor is formed, opening the slit 110 and annealing the opened slit on a mandrel 112 to form the non-welded ring.

The wire segment is formed either as a complete part of or a portion of a wire made of the shape memory alloy. The given length of the wire segment is determined as a proportional quantity for a desired ring size to be formed. Preferably, the given length is approximately one-half the outside circumference of the finally formed ring. Generally, the wire has a given cross-sectional dimension proportional for a desired thickness and width. The wire may include any appropriate diameter for forming a given ring size in light of the disclosure herein as determinable by one skilled in the art. The wire diameter may be narrowed by continuing to draw the wire with, for example without limitation, from about 6% to about 20% reductions in area. Reductions may be interspersed with intermediate annealing at appropriate temperatures, such as from about 375° C. to about 480° C. Preferred wire diameters include, for example, from about 10 mils to about 10,000 mils, with wire diameters of from about 50 mils to about 150 mils more preferred. The preferred method of forming the wire segment includes cutting the wire segment from an extended wire source that sources repeated working samples to a work station, allowing the end of one cut wire segment to part from the end of another cut wire segment, thereby reducing the labor needed to form the wire segments.

The step of annealing the wire segment includes maintaining the wire segment at a specified temperature of a specific length of time with the gradual cooling the heated wire segment at a predetermined rate. The wire segment is annealed at any appropriate temperature as known in the art, with annealing temperatures of from about 375° C. to about 480° C. preferred. As the wire is annealed, the wire segment is preferably drawn, such as from about 3% area to about 30% area, with drawings of from about 6% to about 20% (in area) preferred.

Once annealed at a selected wire diameter, the wire segment is roll flattened to a desired thickness and width. Roll flattening generally requires several passes using for example a device such as the roll flattening equipment manufactured by BHS-Torin of Farmington, Conn. Preferred ratio of thickness to width includes a width that is approximately twice the desired wall thickness of the finally formed ring, with an additional width for a slit or kerf, describe below. The thickness of roll flattened wire segment determines the height of the finally formed ring.

The roll flattened wire segment is then slit along its length, through the centerline, to form the precursor. Generally the slit includes a length that allows a distance of approximately one wall thickness (of the finally formed ring) at each end of the slit to the ends fo the flattened wire, with the distance of the slit to each length end being approximately equal. Slitting may include any appropriate cutting means for slicing the shape memory alloy of the roll flattened wire therethrough, such as a laser cutting device or water jet cutting device. Typical laser cutting devices include, for example, the STS 4000 Model manufactured by PRC Laser of Landing, N.J. Typical water jet cutting devices include, for example, the PHASER ECL manufactured by Flow International Corporation of Kent, Wash.

The precursor is mounted on a mandrel by opening the slit and placing the mandrel therethrough, preferably in a tight fitting manner. Appropriate mandrels include for example without limitation, a steel mandrel sold under the tradename Miser Mandrel manufactured by Dunham Tool Company of New Fairfield, Conn. Prior to mounting on the mandrel, the slit is opened until resistance to further opening is detected, such as for example, openings of approximately 500% of the width of the precursor. As the precursor is worked on the mandrel to define the ring, the precursor is continually annealed in a manner to form the non-welded ring. Annealing preferably includes temperatures of from about 375° C. to about 650° C., with repeated opening and annealing step to achieve circularity of the inner circumference of the ring.

Once the circular form has been achieved, shape recovery properties are instilled into the ring. A tube expander may be used, such as a Son of Bender manufactured by Ben Pearson Tubemaster of Pine Bluff, Ark. to expand the ring. The ring may be expanded and annealed to any appropriate dimensions for a given purpose, with such expansion including for example without limitation, from about 4% to about 12% under annealing temperatures of from about 375° C. to about 480° C. For example, with such processing of Nitinol at 4%–12% at between 375° C.–480° C., the expanded ring generally contracts approximately 4% or more when next heated to the austenitic temperature of the selected Nitinol alloy, such as for example 180° C. Such austenitic temperature is determined by alloy factors such as alloy composition, application and prior thermomechanical treatment.

In one embodiment, the present invention is useful in devices for protecting against pressure build up resulting from undesirable overheating in rockets, such as the MK 66 air-to-ground rocket, such as the device using the Nitinol ring that is described in U.S. Pat. No. 6,321,656 to Johnson, the disclosure of which is hereby incorporated by reference, or other pressure release systems. As such, the present invention provides a thermally actuated release mechanism for venting a container, such as a rocket casing, particularly where the pressure build up can result in catastrophic damage to personnel and property in the vicinity. The inadvertent elevation of temperature can occur, for example, when storing, handling or deploying rockets in the vicinity of a fire or jet exhaust or the like. For example, in the event of fire, the rocket motor propellent burns without further incident, i.e., an insensitive munition, as the Nitinol ring separates the warhead end from the rest of the rocket and vents the forward end of the rocket motor during "cook off". A failure or inability to vent these gases can result in catastrophic damage personnel and property. Formed non-welded rings of the present invention, useful in rocket venting systems are preferably about 2.4 inch i.d., from about 0.005 inch to about 0.1 inch in width and from about 0.015 inch to about 0.32 inch in length.

The present invention is particularly useful in forming coupling devices, such as pipe fittings. When as a coupling device, the non-welded formed ring can join ends of two metal or plastic pipes to form one continuous pipe.

EXAMPLE 1

A Nitinol wire having a diameter of 0.057 inch is cut to a length of 7.90 inch. The wire segment is roll flattened using commercially available roll flattening equipment and annealed at a temperature of 450° C., over one or more cycles to form a segment having a length of 8.00 inch, width of 0.077 inch and thickness of 0.033 inch. Using a water jet cutter, a slit approximately 7.93 inch in length is cut lengthwise in the middle of the segment, leaving a distance of approximately 0.033 inch at each end of the slit (forming the precursor). The slit is opened and inserted over a round steel mandrel. The precursor is annealed at a temperature of 425° C. over one or more cycles to form a non-welded ring. The formed non-welding ring has an i.d. of 1.26 inch, width of 0.031 inch and thickness of 0.033 inch. The non-welded ring is annealed at a temperature and expanded 6% to impart shape recovery properties into the ring. The expanded ring has an i.d. of 1.34 inch, width of 0.031 inch and thickness of 0.031.

The present invention provides a method for producing SMA rings with improved properties in an efficient manner that lowers the cost of fabrication.

The foregoing summary, description, and examples of the present invention are not intended to be limiting, but are only exemplary of the inventive features which are defined in the claims.

What is claimed is:

1. A method for producing a non-welded shape memory alloy ring, comprising the steps of:

forming a wire segment comprising a shape memory alloy to a given length proportional to a desired ring size, wherein said wire has a given cross-sectional dimension proportional for a desired thickness and width;

annealing the wire segment;

roll flattening the annealed wire segment to the desired thickness and width;

slitting the length of the roll flattened wire along the centerline, wherein a precursor is formed;

opening the slit; and, annealing the opened slit on a mandrel, wherein a non-welded ring is formed.

2. The method of claim 1, wherein the shape memory alloy comprises Nitinol.

3. The method of claim 2, wherein the given length is approximately one-half the outside circumference of the formed ring.

4. The method of claim 2, wherein the wire comprises a diameter of from about 10 mils to about 10,000 mils.

5. The method of claim 2, wherein the wire comprises a diameter of from about 50 mils to about 150 mils.

6. The method of claim 3, wherein the step of slitting the length of the roll flattened wire along the centerline is performed with a laser cutting device or water jet cutting device.

7. The method of claim 2, further comprising the step of expanding the formed ring and annealing the expanded ring.

8. The method of claim 7, wherein the formed ring is expanded from about 4% to about 12%.

9. The method of claim 1, wherein the step of forming a wire segment comprises cutting a wire.

10. The method of claim 3, wherein the step of annealing the cut wire occurs at a temperature of from about 375° C. to about 480° C.

11. The method of claim 3, wherein the step of annealing the cut wire occurs with drawings of from about 6% to about 20% in area.

12. The method of claim 3, wherein the step of roll flattening the annealed cut wire to the desired thickness and width comprises flattening to a width approximately twice the thickness.

13. The method of claim 1, wherein the step of annealing the opened slit on a mandrel occurs at a temperature of from about 375° C. to about 650° C.

14. A method for producing a non-welded shape memory alloy ring, comprising the steps of:

forming a wire segment comprising a shape memory alloy;

flattening the wire segment to a desired thickness and width;

slitting the length of the flattened wire segment along the centerline, wherein a precursor is formed;

opening the slit; and, annealing the opened slit on a mandrel in a manner effective to form a non-welded ring.

* * * * *